US005533713A

United States Patent [19]

Angeler et al.

[11] Patent Number: 5,533,713

[45] Date of Patent: Jul. 9, 1996

[54] GAS AND/OR SOLID MATERIAL BLASTING DEVICE FOR A METALLURGICAL VESSEL AND METHOD OF MANUFACTURE THEREOF

[75] Inventors: Alois Angeler, Mühlheim an der Ruhr; Harald Kaune, Krefeld; Theo Scheuten, Duisburg-Huckingen, all of Germany

[73] Assignee: Didier-Werke AG, Wiesbaden, Germany

[21] Appl. No.: 388,577

[22] Filed: Feb. 14, 1995

[30] Foreign Application Priority Data

Apr. 2, 1994 [DE] Germany ..... 44 11 538.5

[51] Int. Cl.[6] ..... C21C 5/48

[52] U.S. Cl. ..... 266/218; 266/265

[58] Field of Search ..... 266/217, 220, 266/218, 265, 45

[56] References Cited

U.S. PATENT DOCUMENTS 4,539,043 9/1985 Miyawaki et al. ..... 266/265

4,647,020 3/1987 Liesch et al. ..... 266/218

*Primary Examiner*—Scott Kastler

*Attorney, Agent, or Firm*—Wenderoth, Lind & Ponack

[57] ABSTRACT

A blasting device to be used to introduce a gas and/or a solid material into a metallurgical vessel such as a convertor includes a plurality of blasting tubes arranged in a tube bundle, with ends of the tubes being inserted into respective receiving bores formed in a metal apertured plate, with a press fit therebetween. A space defined within the tube bundle is filled with a prefabricated ceramic internal member. The tube bundle with the internal member therein are positioned within a pressing mold that is partially filled with a portion of ceramic material to be used to form a blasting brick. The remainder of the ceramic material to form the blasting brick then is filled into the interior of the pressing mold. The mold then is operated to press the ceramic material to form a blasting brick with the tube bundle and internal member situated therein.

26 Claims, 5 Drawing Sheets

GAS AND/OR SOLID MATERIAL BLASTING DEVICE FOR A METALLURGICAL VESSEL AND METHOD OF MANUFACTURE THEREOF

BACKGROUND OF THE INVENTION

The present invention relates to a method of manufacturing a blasting device to be used to introduce a gas and/or solid material into a metallurgical vessel, particularly a convertor, the device including a ceramic blasting brick with metallic blasting tubes pressed or embedded therein, the ends of the tubes at the base of the brick being secured to a metallic or metal apertured plate. The invention also relates to a blasting device manufactured in accordance with such method.

Blasting devices of this type serve, as is known, to supply gases and/or solid materials to a metal melt situated within the metallurgical vessel.

Such a blasting device is described in U.S. Pat. No. 4,539,043 for a convertor base. A blasting device of the same type is also known for an electric furnace from Radex-Rundschau, Volume 1, 1990, pages 195 to 202. In both cases the metallic blasting tubes are pressed or embedded into the ceramic material of the blasting brick which, as is known, is pressed with a very high volumetric compression ratio. This has the result that, after the pressing process, the positions of the metallic blasting tubes in the blasting brick frequently differ substantially from the installed positions originally provided. The function of the blasting brick is, on the one hand, thereby impaired to a considerable extent. On the other hand, however, difficulties also arise in the completion of the blasting brick since it is practically impossible due to the differing installed positions of the blasting tubes to use a prefabricated apertured plate with defined tube connection points. In the known gas and/or solid material blasting devices of the type referred to above, it is, therefore, in practice often necessary to adapt the apertured plate to the final installed positions of the blasting tubes and to secure such tubes subsequently to the apertured plate, whereby in practice only expensive welded connections ensure the necessary seal of the tube connecting and fastening points.

SUMMARY OF THE INVENTION

It is the object of the invention to avoid the above and other prior art disadvantages and to provide a method of manufacturing a gas and/or solid material blasting device of the type referred to above which makes simplification of the manufacturing process possible and at the same time, particularly in the case of mass production, results in always achieving uniform blasting performance, both quantitatively and qualitatively.

This object is achieved in accordance with the invention by first inserting the blasting tubes in the form of a tube bundle into receiving bores in the apertured plate with the production of a press fit, thereby defining a space within the tube bundle. Such space subsequently is filled with a prefabricated, ceramic internal member. The tube bundle secured to the apertured plate is then inserted, with the prefabricated ceramic internal member situated therein, into a pressing mold partially filled with a portion of the ceramic material that is to form the blasting brick. The pressing mold subsequently is completely filled with the remainder of the ceramic material of the blasting brick. The mold then is operated to press the filled ceramic material, together with the tube bundle and the prefabricated, ceramic internal member situated therein, thereby forming the blasting brick with the tube bundle precisely embedded therein.

The assembly comprising the apertured plate with the tube bundle secured thereto and the ceramic internal member situated therein thus constitutes a prefabricated insert. The ceramic internal member operates in accordance with the invention to fix the blasting tubes in the desired installation positions during the pressing process. A number of advantages are produced thereby. On the one hand, it thereby is possible to secure the blasting tubes to the apertured plate at the beginning of the manufacturing operation and for this purpose to use a connection method that is simpler than conventional welding, namely a press fit. The complete tube bundle can thus, contrary to the prior art, be inserted into the pressing mold together with the ceramic internal member situated therein in a single working step. On the other hand, the method in accordance with the invention offers the advantage of precisely positioning the blasting tubes in the blasting brick which, particularly in mass production, is a prerequisite for the blasting device subsequently always being able to operate functionally correctly and precisely.

The type and character of the ceramic material for the blasting brick are well known from the general state of the art. The prefabricated ceramic inner member, which provides support of the device during the pressing process, is advantageously manufactured from the same ceramic material as the blasting brick. In accordance with the invention it is, however, also possible, depending on the particular application, to manufacture the prefabricated, ceramic internal member and the blasting brick from different ceramic materials. The prefabricated, ceramic internal member and/or the blasting brick also can be manufactured from different ceramic materials in zones in the blasting direction of the device, for instance to obtain better wear performance of the blasting device in the blasting direction thereof. It can also be advantageous from the manufacturing point of view to manufacture the prefabricated, ceramic internal member as a drill core, preferably from a blasting brick of the same type.

In order to secure the blasting tubes to the apertured plate, the invention provides that the apertured plate is shrunk onto the ends of the blasting tubes inserted into the receiving bores in the apertured plate. Since the blasting tubes remain immovably held during the pressing process by the prefabricated, ceramic internal member, such shrink connection is sufficient for a perfectly gas-tight connection of the blasting tubes to the apertured plate.

It is provided in a further embodiment of the invention that the apertured plate is constructed as an end wall of a metallic or metal sleeve which, after insertion of the tube bundle into the pressing mold-and filling on the same with the ceramic material of the blasting brick, is completely surrounded on all peripheral sides by the ceramic material of the blasting brick. In this manner it is possible to use the space within the metallic sleeve as a gas distribution chamber within the blasting brick.

In the method in accordance with the invention it is also readily possible to insert a plurality of tube bundles with respective prefabricated, ceramic internal members into the pressing mold partially filled with the ceramic material of the blasting brick, then completely to fill the pressing mold with the remainder of the ceramic material of the blasting brick, and finally to press the ceramic material together with the tube bundles and the ceramic internal members disposed therein. Thereby, it is possible to provide a blasting device having embedded therein plural arrangements of blasting tubes. These blasting tubes can be used to alter the blasting performance of a given vessel with regard to the particular requirements thereof, both functionally and also volumetrically. For example, tubes of the respective tube arrangements can be of different size. Alternatively, different injecting arrangements can be connected to the different tube arrangements.

In a gas and/or solid material blasting device manufactured in accordance with the invention, the apertured plate can be provided with a circular ring of receiving bores for the blasting tubes and the prefabricated, ceramic internal member then is cylindrical. The apertured plate can, however, also be provided with a polygonal ring or annulus of receiving bores for the blasting tubes within the scope of the invention, whereby the prefabricated, ceramic internal member is then polygonal in transverse section and prismatic. In order to hold the blasting tubes together as securely as possible, the invention also provides that the prefabricated, ceramic internal member closely or directly engages the blasting tubes on all sides over the entire length of the tubes. If necessary, the prefabricated internal member can be provided on all sides with grooves accommodating the blasting tubes.

In order to achieve as favorable a blasting action as possible, the blasting tubes can be helically twisted in the blasting direction. The blasting tubes advantageously have a circular flow passage but can also, for instance, have an elongate, preferably oval, flow passage as viewed in transverse section.

In a gas and/or solid material blasting device having blasting tubes secured to a metallic sleeve, the invention provides that the metallic sleeve has an end wall constituting the apertured plate and is provided at both ends with flanges as anchoring elements for anchoring the metallic sleeve in the ceramic blasting brick.

It also is possible in accordance with the present invention to provide, in addition to the one tube bundle discussed above, a further tube bundle or a further individual tube also secured to the metal or metallic apertured plate. Such additional tube bundle or individual tube can be arranged concentrically with the above discussed one tube bundle. Between the above discussed one tube bundle and the additional tube bundle or individual tube arranged therein there will be formed an annular hollow space. Such space may be cylindrical or prismatic, as discussed above. When the one tube bundle discussed above has arranged concentrically therein a further tube bundle, there will be an annular space between the two tube bundles and a cylindrical space within the inner tube bundle. Both spaces will be filled with respective prefabricated ceramic internal members, one annular and one that is solid. When the one tube bundle discussed above has positioned concentrically therein a further individual tube, there will be one space defined therebetween, and such space will be annular.

The invention also envisages providing the blasting brick, if required, with a plurality of tube bundles arranged adjacent one another, each tube bundle having a respective prefabricated ceramic internal member. In this manner it is possible to alter the blasting characteristics and the blasting performance of the blasting brick from case to case in accordance with relevant particular requirements within broad limits.

BRIEF DESCRIPTION OF THE DRAWINGS

The above and other objects, features and advantages of the present invention will be apparent from the following detailed description of preferred embodiments thereof, with reference to the accompanying drawings, wherein.

DETAILED DESCRIPTION OF THE INVENTION

Figure 1:
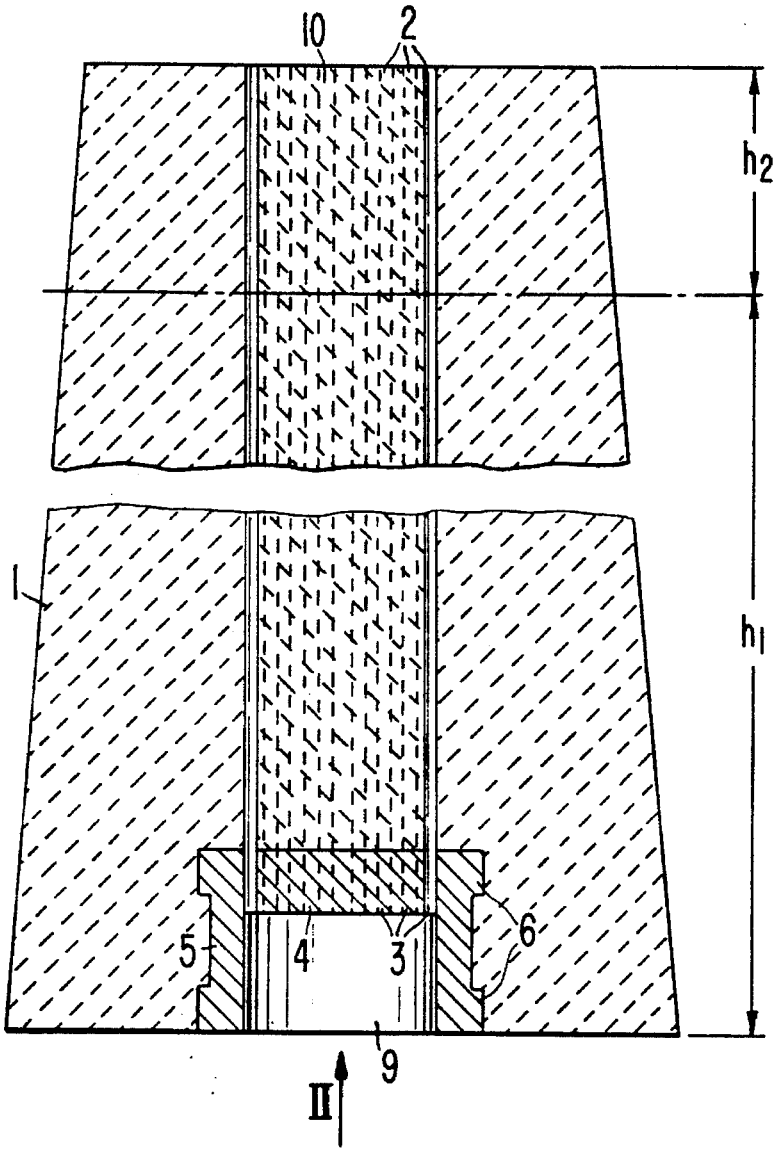
FIG. 1 is a longitudinal sectional view of a blasting device manufactured in accordance with one embodiment of the present invention.
Figure 2:
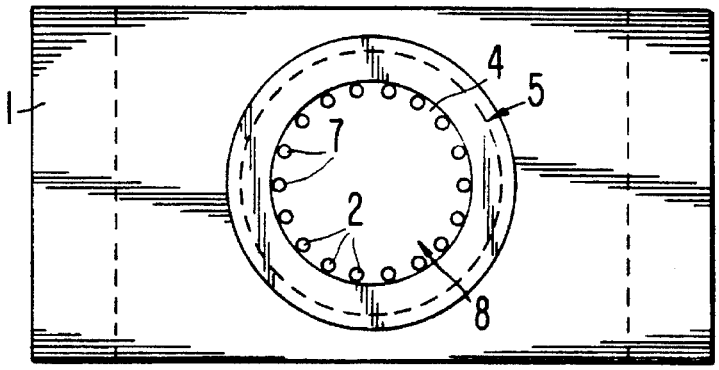
FIG. 2 is an end view of the device of FIG. 1 as viewed in the direction of arrow II therein.

The blasting device shown in FIGS. 1 and 2 comprises a ceramic blasting brick 1 with metallic or metal blasting tubes 2 pressed or located therein. Ends 3 of tubes 2 are secured at the base of the brick to a metal or metallic apertured plate 4 that is manufactured as an end wall of a metal or metallic sleeve 5 with flanges 6 which serve as anchoring elements for anchoring the sleeve 5 in the blasting brick 1. In order to secure the tubes 2 to the apertured plate 4, a circular ring of receiving bores 7 is provided therein into which the tubes 2 are pushed at the base of the brick as a press fit. The press fit can, for instance, be produced by expanding the ends 3 of the tubes in the receiving bores 7 or by shrinking the apertured plate 4 onto the ends 3 of the tubes. The tubes 2 secured in this manner to the apertured plate 4 constitute a tube bundle 8 whose tubes 2 extend from the apertured plate 4 to the opposite end surface of the blasting brick 1 so that, after installation of the blasting brick 1 in a metallurgical vessel, the internal flow passages of the tubes 2 communicate on the one hand at the base end of the brick with a space 9 within the metallic sleeve 5 serving as a gas distribution chamber and on the other hand with the interior of the metallurgical vessel.

The space defined by and within the tube bundle 8 is filled with a prefabricated ceramic internal member 10 which is manufactured from the same ceramic material as the remainder of the blasting brick 1. It is, however, also possible, if necessary, to manufacture the prefabricated ceramic internal member 10 and the remainder of the blasting brick 1 from different ceramic materials. It is also possible to manufacture the prefabricated ceramic internal member 10 and/or the blasting brick 1 of different ceramic materials in zones in the blasting direction of the brick, for instance in the longitudinal zones h1 and h2. The prefabricated ceramic internal member 10 is of generally cylindrical construction and can be manufactured as a drill core from a similar blasting brick 1 to closely or directly engage the blasting tubes 2 on all sides.

The blasting tubes 2 each have a circular flow passage. They can, however also, if required, have an elongated, preferably oval, flow passage as viewed in transverse section.

Figure 10:
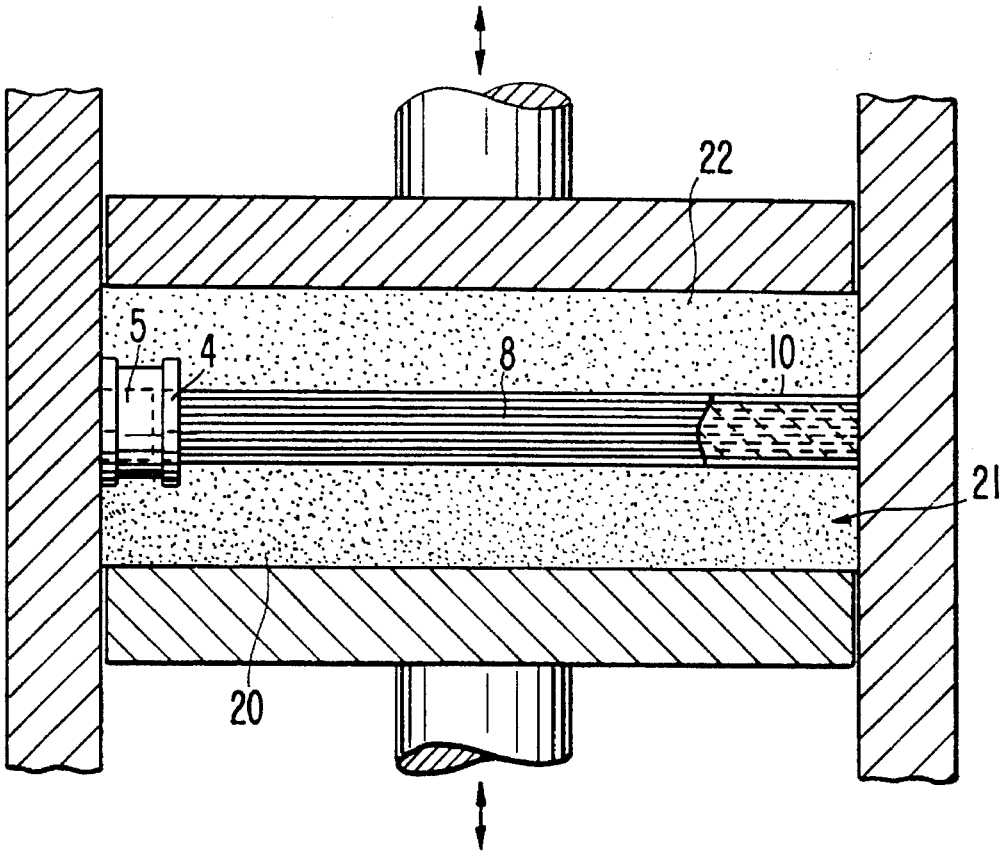
FIG. 10 is a schematic longitudinal sectional view of a pressing mold employed in accordance with the present invention to produce a device similar to that illustrated in FIG. 1.

The blasting device of FIGS. 1 and 2 is manufactured in accordance with the invention as follows. The blasting tubes 2 are first inserted in the form of a bundle 8 into the receiving bores 7 in the apertured plate 4 with the production of a press fit therebetween. The internal space defined by the tube bundle 8 is subsequently filled with the prefabricated ceramic internal member 10. The assembly comprising the metallic sleeve 5 with the apertured plate 4 and the tube bundle 8 secured thereto and the ceramic internal member 10 situated therein constitutes a prefabricated insert which, as seen in FIG. 10, is subsequently inserted into a pressing mold 21 partially filled with ceramic material 20 to form the blasting brick 1. The pressing mold 21 is subsequently completely filled with the remainder of ceramic material 22 of the blasting brick 1. The filled ceramic material 20, 22 is finally pressed together with the metallic sleeve 5, the tube bundle 8 secured thereto and the internal member 10 situated therein until the desired final external shape of the blasting brick 1 has been produced.

The tubes 2 of the tube bundle 8 are held together or held in position in accordance with the invention by the prefabricated ceramic internal member 10 so that tubes 2 retain their precise installed positions during the pressing process.

The ceramic material of the filling 20, 22 comprises, as is known, different granular and/or pulverulent ceramic materials with suitable grain size into which a suitable bonding agent is mixed.

In the present embodiment, the metallic sleeve 5 is wholly surrounded on all peripheral sides by the ceramic material 20, 22 of the blasting brick. In order to increase the usable length of the blasting brick 1, it is, however, also possible by appropriate reconfiguring of the pressing mold 21 to arrange the metallic sleeve 5 outside the blasting brick 1 so that the end surface of the inner flange 6 is flush with the base end surface of the blasting brick 1.

Figure 3:
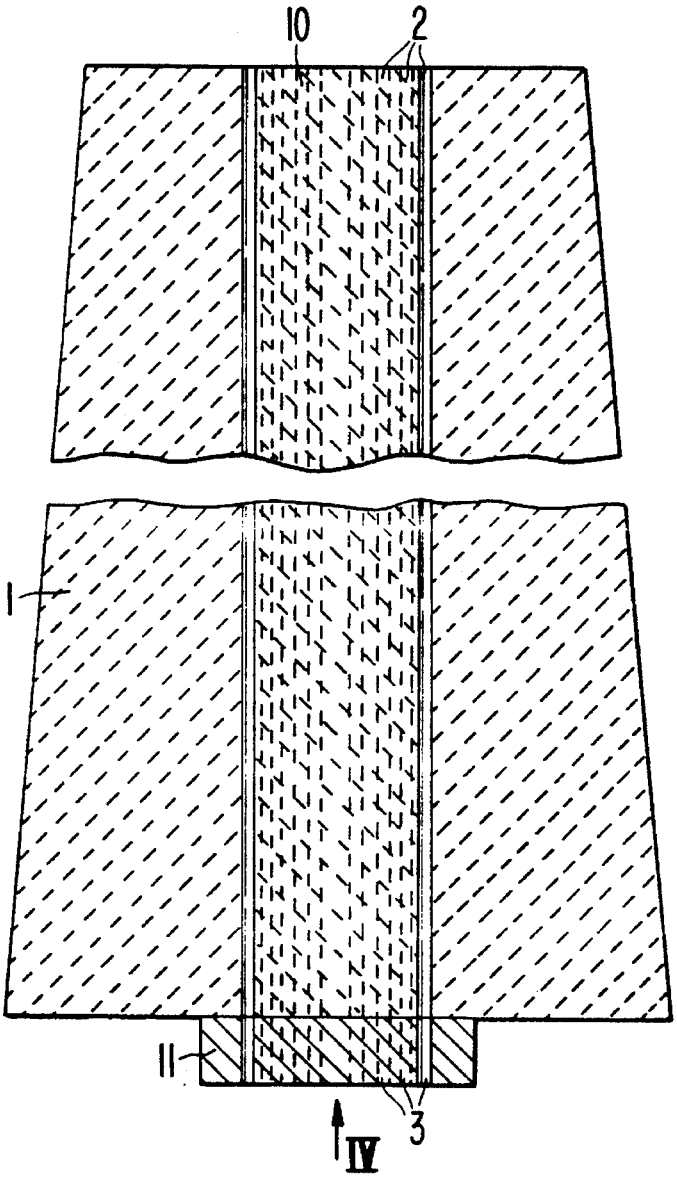
FIG. 3 is a view similar to FIG. 1 but of a further embodiment of the present invention.
Figure 4:
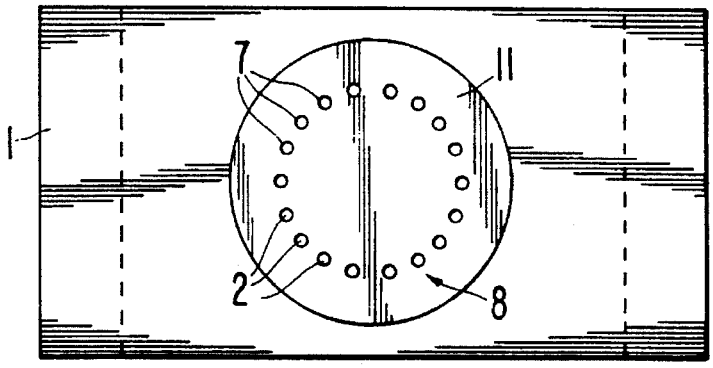
FIG. 4 is a view similar to FIG. 2 but in the direction of arrow IV in FIG. 3.

The blasting device shown in FIGS. 3 and 4 differs from the blasting device shown in FIGS. 1 and 2 substantially only in that instead of the metallic sleeve 5 an apertured plate 11 is provided with the receiving bores 7 for the tubes 2. The apertured disc or plate 11 is arranged on the exterior of the nozzle brick 1. Plate 11 can, however, also be positioned in the blasting brick 1 in a manner similar to the metallic sleeve 5. A metallic gas distribution chamber may be connected to the apertured disc 11.

Figure 5:
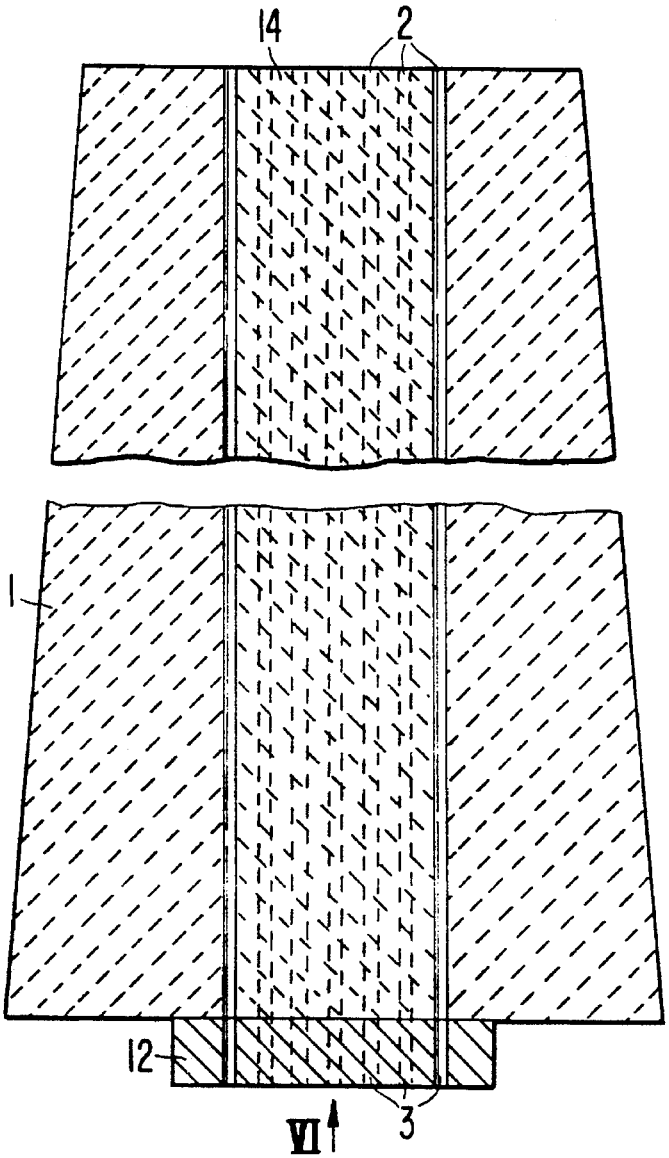
FIG. 5 is a view similar to FIG. 3 but of a further embodiment of the present invention.
Figure 6:
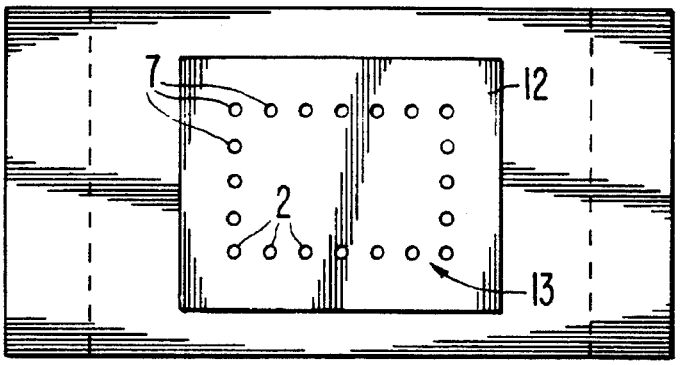
FIG. 6 is a view similar to FIG. 4 but in the direction of arrow VI in FIG. 5.

The blasting device shown in FIGS. 5 and 6 differs from the blasting device shown in FIGS. 3 and 4 merely in that it is provided with a rectangular apertured plate 12 with a polygonal ring of receiving bores 7 for the tubes 2 instead of the apertured disc 11. The interior of tube bundle 13 is accordingly filled with a prefabricated ceramic internal member 14 of prismatic construction.

Figure 7:
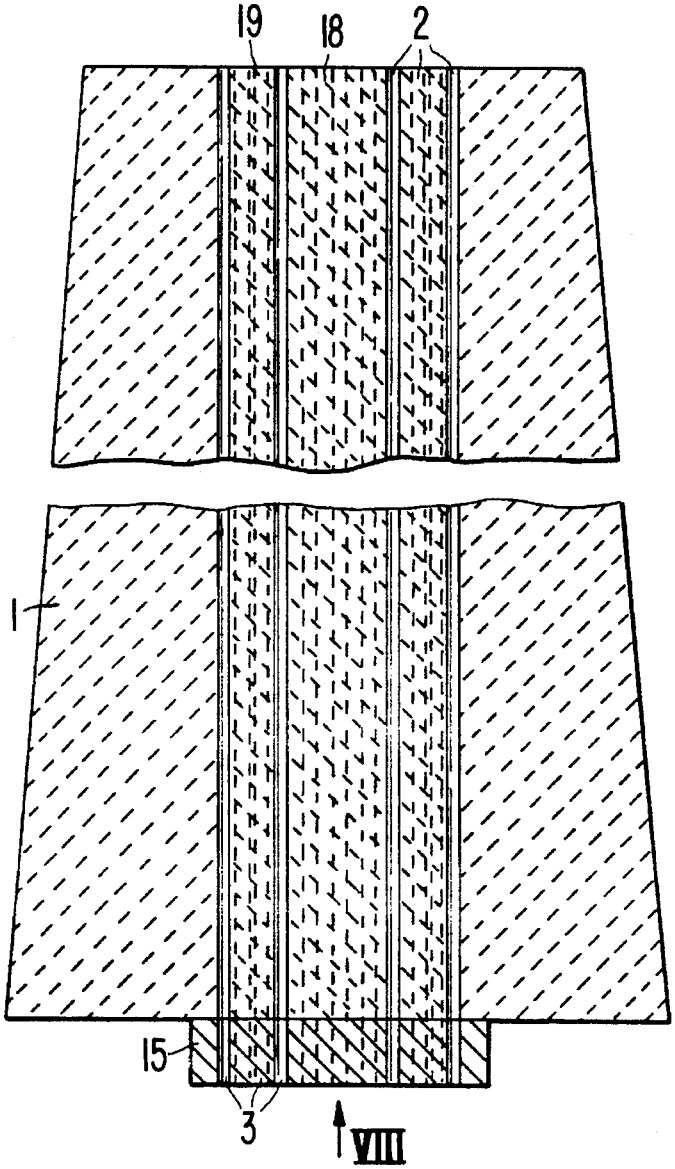
FIG. 7 is a view similar to FIG. 5 but of a further embodiment of the present invention.
Figure 8:
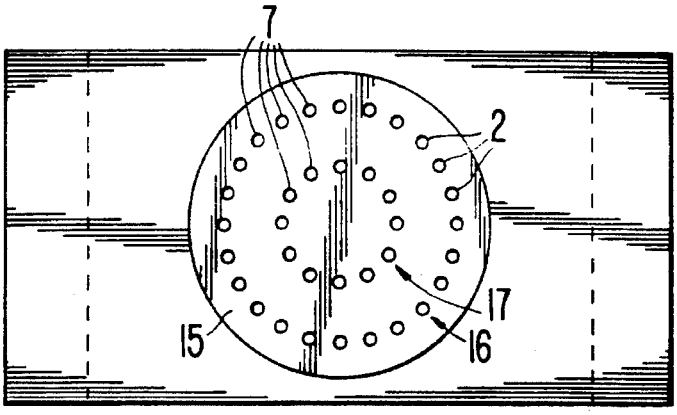
FIG. 8 is a view similar to FIG. 6 but in the direction of arrow VIII of FIG. 7.

The blasting device shown in FIGS. 7 and 8 differs from the blasting device shown in FIGS. 3 and 4 merely in that secured to an apertured disc 15 are two coaxially disposed tube bundles 16, 17. Internal and intermediate spaces within bundle 17 and between bundles 16 and 17, respectively, are filled with a cylindrical, prefabricated, ceramic internal member 18 and a hollow cylindrical, prefabricated, ceramic internal member 19, respectively. If required, intermediate spaces between the two prefabricated, ceramic internal members 18 and 19 and the tubes 2 can be filled with a suitable ceramic material, for instance a pourable composition. It is, however, also possible to provide the prefabricated, ceramic internal members 18, 19 with longitudinal grooves accommodating the tubes 2.

It is of course also possible to provide the corresponding arrangement of tube bundles of FIGS. 7 and 8 in the blasting device shown in FIGS. 5 and 6, whereby the two prefabricated, ceramic internal members would be of prismatic or hollow prismatic shape.

It is further possible to secure the tube bundle arrangement of the blasting devices shown in FIGS. 3 and 4, FIGS. 5 and 6 and FIGS. 7 and 8 to a metallic or metal sleeve corresponding to the sleeve 5 in FIGS. 1 and 2.

Figure 9:
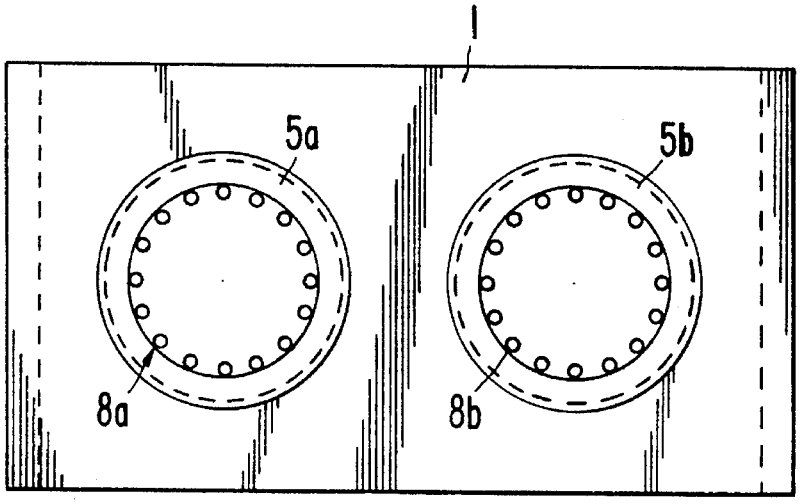
FIG. 9 is a view similar to FIG. 2 but of a modification of the embodiment thereof.

The blasting device shown in FIG. 9 differs from the blasting device shown in FIGS. 1 and 2 merely in that two sleeves **5*a*, 5*b* extending parallel to one another with respective tube bundles 8*a*, 8*b* are pressed or provided in the blasting brick 1**. Similar multiple arrangements are of course possible in all the other described modifications of the blasting device in accordance with the invention.

Although the present invention has been described and illustrated with respect to preferred features, it is to be understood that various changes and modifications may be made to the specifically described and illustrated arrangements without departing from the scope of the present invention.

We claim:

1. A blasting device to be used to introduce a material into a metallurgical vessel, said device comprising:

a metal apertured plate having therein a plurality of receiving bores;

a plurality of blasting tubes arranged in a tube bundle, with ends of said tubes being inserted into respective said receiving bores with a press fit therebetween, said tube bundle enclosing and defining an internal space within said tube bundle;

a prefabricated ceramic internal member positioned in and filling said space, said internal member having an outer boundary not extending outwardly beyond a boundary of said tube bundle; and a blasting brick surrounding said tube bundle and said internal member, said blasting brick comprising ceramic material molded and pressed around said tube bundle and said internal member, said internal member and said blasting brick being separate but joined members.

2. A blasting device as claimed in claim 1, wherein said blasting brick has therein a plurality of tube bundles each having therein a respective said internal member.

3. A blasting device as claimed in claim 1, wherein said internal member is formed of ceramic material the same as said ceramic material of said blasting brick.

4. A blasting device as claimed in claim 1, wherein said internal member is formed of ceramic material different than said ceramic material of said blasting brick.

5. A blasting device as claimed in claim 1, wherein said internal member is formed of different ceramic materials in a blasting direction of said device.

6. A blasting device as claimed in claim 5, wherein said ceramic material of said blasting brick is of different ceramic materials in said blasting direction.

7. A blasting device as claimed in claim 1, wherein said ceramic material of said blasting brick is of different ceramic materials in a blasting direction of said device.

8. A blasting device as claimed in claim 1, wherein said internal member comprises a drill core.

9. A blasting device as claimed in claim 8, wherein said drill core is formed of ceramic material the same as said ceramic material of said blasting brick.

10. A blasting device as claimed in claim 1, wherein said apertured plate comprises an end wall of a metal sleeve, and said blasting brick completely peripherally surrounds said sleeve.

11. A blasting device as claimed in claim 10, wherein said sleeve has at opposite ends thereof outwardly extending flanges anchoring said sleeve into said blasting brick.

12. A blasting device as claimed in claim 1, wherein said internal member is formed of different ceramic materials in a blasting direction of said device.

13. A blasting device as claimed in claim 1, wherein said internal member comprises a drill core.

14. A blasting device as claimed in claim 1, wherein said apertured plate comprises an end wall of a metal sleeve.

15. A blasting device as claimed in claim 14, wherein said sleeve has at opposite ends thereof outwardly extending flanges to be used to anchor said sleeve in a blasting brick.

16. A blasting device as claimed in claim 1, wherein said receiving bores are arranged in a circular ring, and said internal member has a cylindrical configuration.

17. A blasting device as claimed in claim 1, wherein said receiving bores are arranged in a polygonal ring, and said internal member has a prismatic configuration.

18. A blasting device as claimed in claim 1, wherein said tubes extend rectilinearly in a blasting direction.

19. A blasting device as claimed in claim 1, wherein said tubes are twisted helically in a blasting direction.

20. A blasting device as claimed in claim 1, wherein said internal member directly engages said tubes.

21. A blasting device as claimed in claim 1, wherein said internal member is directly engaged on all sides thereof by said tubes.

22. A blasting device as claimed in claim 1, wherein said tubes each have an a circular internal flow passage.

23. A blasting device as claimed in claim 1, wherein said tubes each have an internal flow passage that is elongated in transverse section.

24. A blasting device as claimed in claim 1, further comprising at least one additional tube within said tube bundle.

25. A blasting device as claimed in claim 1, further comprising another tube bundle surrounding said tube bundle and defining an annular space therebetween, and an annular prefabricated ceramic internal member position in and filling said annular space.

26. A blasting device as claimed in claim 25, wherein said tube bundle and said another tube bundle are arranged concentrically.

* * * * *